United States Patent [19]

Mallek

[11] Patent Number: 4,561,363

[45] Date of Patent: Dec. 31, 1985

[54] METHOD AND CHAMBER FOR COMBUSTION OF EFFLUENT GASES FROM THE PYROLYSIS OF COMBUSTIBLE MATERIAL

[75] Inventor: Heinz Mallek, Linnich-Tetz, Fed. Rep. of Germany

[73] Assignee: Kernforschungsanlage Jülich GmbH, Jülich, Fed. Rep. of Germany

[21] Appl. No.: 596,678

[22] Filed: Apr. 4, 1984

[30] Foreign Application Priority Data

Apr. 9, 1983 [DE] Fed. Rep. of Germany ..... 3312863

[51] Int. Cl.[4] ..... F23G 5/00

[52] U.S. Cl. ..... 110/229; 48/61; 110/346

[58] Field of Search ..... 110/229, 245, 346; 48/61

[56] References Cited

U.S. PATENT DOCUMENTS 2,354,963 8/1944 Ohlsson ..... 110/229

2,592,730 4/1952 Perkins ..... 110/229

4,213,404 7/1980 Spaulding ..... 110/229

4,231,302 11/1980 Linneborn ..... 110/229

*Primary Examiner*—Edward G. Favors

*Attorney, Agent, or Firm*—Frishauf, Holtz, Goodman & Woodward

[57] ABSTRACT

Combustible gases produced by pyrolysis of combustible material undergo partial combustion in a combustion chamber to which air is admitted in substoichiometric quantity ratio, at a temperature of about 800° C. A gas duct leading out of the combustion chamber and passing partly or all the way across the combustion chamber with one or more openings for entrance of the combustible gas is supplied with additional air in at least stoichiometric quantity ratio, with the result that complete combustion of the combustible gas takes place within the duct as the gases pass out of the combustion chamber, at a temperature of about 1100° C., producing a flame jet that can be used to heat an adjacent boiler, heat exchanger, or the like.

20 Claims, 5 Drawing Figures

CONTROL FOR SLUICE 3

II
II

METHOD AND CHAMBER FOR COMBUSTION OF EFFLUENT GASES FROM THE PYROLYSIS OF COMBUSTIBLE MATERIAL

The invention relates to a method and apparatus for combustion of material, especially waste material, in which combustible gases are generated and led into a combustion chamber.

Such methods are known, for example, from an article in Maschinenmarkt, Würzburg, vol. 81 (1975) 69, p. 1293, where a so-called high temperature process is described according to which garbage is burned up and the combustion of the gases formed by pyrolysis takes place in a separate combustion chamber. A process is also known from German Pat. No. 26 04 408 in which gases arising from the pyrolysis of waste are led into a combustion chamber and there burned up.

In the combustion of gases given off by heating waste, the burning up of such gases to the most complete extent possible is desired to avoid the escape of residual gases unfriendly to the environment. Furthermore, if the appreciable heat produced by the burning of these gases is to be used, their complete combustion is desired in order to improve the energy balance.

The complete combustion of the gases given off, in which the chemical conversion of the aromatic components of the gases takes place, is possible only at relatively high temperatures in the combustion chamber, which has to be above 1000° C., however. Although such high temperatures can be reached during the performance of known processes, as, for example, in the process known from German Pat. No. 26 04 409, the establishment of such high temperatures still leads to difficulties in the known process to the extent that ashes located in the combustion chamber cannot be prevented from melting. Such melting leads to undesired deposits of coatings in the combustion chamber and thereby to interference with the operation of the process.

SUMMARY OF THE INVENTION

It is an object of the invention to provide a process of the above-described kind which makes possible, burning up of the gases given off as completely as possible and without undesirable effects impairing the carrying on of the process. It is also an object of the invention to provide a suitable combustion chamber for carrying out the method of the invention.

Briefly, the gases to be burned up completely are separately guided from within the combustion chamber to their exit therefrom while being mixed with fresh air. The separate leading out of the combustible gases makes it possible—in connection with the readily controllable addition of fresh air to the separately ducted gases—to establish the necessary temperatures for the complete combustion of the gases within a limited region. The remaining volume of the combustion chamber can then be kept at a lower temperature, so that the temperature loading of the combustion chamber walls can be kept lower and other disadvantages, such as, for example, the melting of the ashes, can be avoided. That is particularly the case in the preferred embodiment of the process of the invention in which the gases given off in pyrolysis are separately led out of the combustion chamber from a region in the center of the combustion chamber or in a path through the center of the combustion chamber.

The separate exit-ducting of the combustible gases also makes possible particularly favorable conditions for starting up the operation of the combustion chamber. Thus, if these gases are ignited in a limited region of the separate ducting, this region can be very rapidly brought up to the temperature, of about 800° C., necessary for the formation of clean residual gases.

A particularly advantageous variant of the method of the invention consists in supplying fresh air in substoichiometric quantitative ratio to the pyrolysis gases in the combustion chamber and, supplementarily, leading fresh air in at least stoichiometric quantitative ratio to these gases in their separate exit duct. By suitable dimensioning of the fresh air quantities it is possible to establish the desired high temperatures in the limited region of the separately guided waste gases and lower temperatures in the remaining region of the combustion chamber. For carrying out the process of the invention it is suitable to use a combustion chamber in which at least one gas duct, passing through the combustion chamber or leading out from its interior, provided with one or more openings giving access to the duct from the combustion chamber, forms, at one end, the outlet of the combustion chamber, or connects with such an outlet, and can also be connected with a fresh air supply line. The gas duct just mentioned preferably consists of refractory material such as ceramic or fire resistant steel.

A preferred embodiment of the combustion chamber has the feature that the gas exit duct either passes through the center of combustion chamber or leads outward from the center of the combustion chamber.

A simple embodiment of the combustion chamber of the invention provides a gas outlet duct constituted of a tube with openings in its side wall. The openings may face the upper part of the combustion chamber, the lateral parts of the combustion chamber or even the ash removal port of the chamber. In fact, the provision of openings which face the ash removal equipment is preferred, in order to prevent fly ash or other dust particles from getting into the gas exit duct. It is convenient in such a case for the gas exit duct to pass right through the interior of the combustion chamber, and for the fresh air supply line to be connectable at its end opposite the outlet of the combustion chamber. The fresh air supply can however, for example, also be provided by the fresh air pipe projecting into the the gas exit duct. The choice thereby given for the location of the leading in of fresh air makes it possible to influence the progress of the combustion in the combustion chamber and/or in the gas exit line, not only by the control of the quantity of fresh air, but also by the selection of the place at which the air is fed in. By the fixing of the location of air feed, for example, the dwell time of the combustible gases in the part of the gas exit line lying downstream of the air injection place can be taken into account.

The combustion chamber according to the present invention can advantageously be used in a combustion installation for burning up combustible materials, for example, waste material, in which the combustible material is first pyrolized in a chamber provided for that purpose, after which the gases produced in the pyrolysis are conducted into the combustion chamber. The provision of a combustion chamber in accordance with the invention in such an installation makes possible a particularly effective control of the combustion operation taking place in the combustion chamber.

According to the choice made regarding the feeding in of fresh air to the gas ducts leading to the outlet from the combustion chamber, the separate guiding of the combustible gases in the combustion chamber, with, at the same time, equally intensive combustion of the gas, has the effect of providing a concentrated jet of flame directed across the interior of the combustion chamber toward the exterior. For obtaining a flame jet directed as much as possible beyond the combustion chamber, it is desirable for the fresh air to be supplied to the separately ducted gases only in the neighborhood of the exit from the combustion chamber, or even also beyond the limits of the combustion chamber. The combustion chamber according to the invention is then capable of being used particularly well in a combustion installation for consuming combustible material in which some equipment for utilizing the appreciable heat developed is connected downstream of the outlet from the combustion chamber. Thus, for example, a boiler of a heating system can be so disposed next to the combustion chamber, with the flame jets coming out of the outlet gas duct of the combustion chamber being directed upon the heat exchanger of the boiler or a hot water vessel.

BRIEF DESCRIPTION OF THE DRAWINGS

The combustion chamber according to the invention is further described in an illustrated example in which it serves as the combustion chamber of a furnace for burning up waste materials, with reference to the annexed drawings in which such a combustion installation is schematically illustrated and in which.

DESCRIPTION OF THE ILLUSTRATED EMBODIMENTS

Figures 1, 2, 5:
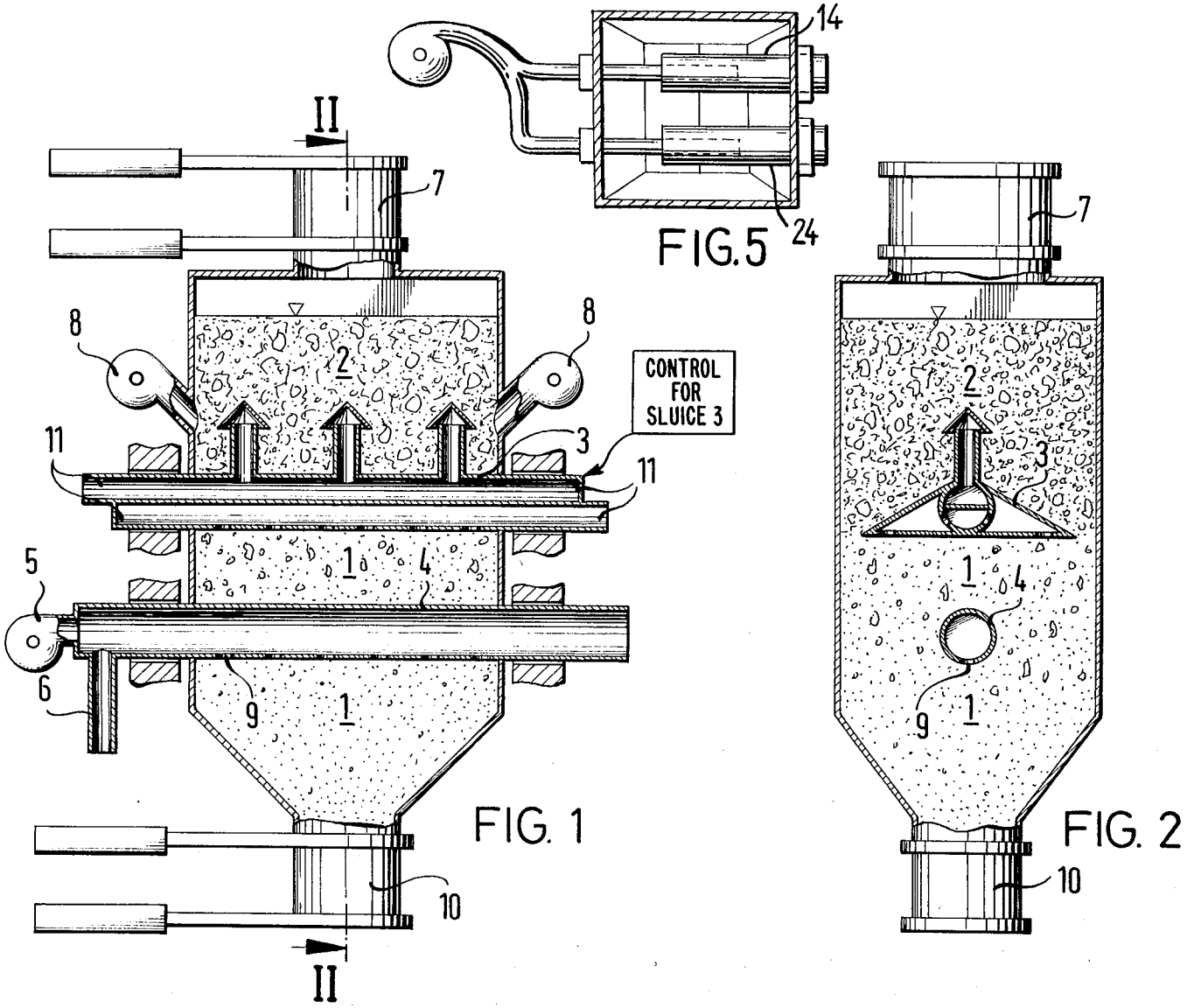
FIG. 1 is a schematic cross-section of a combustion installation in which a combustion chamber according to the invention is equipped with a gas duct passing right through the combustion chamber and a fresh air feed is provided at the beginning end of the gas duct.
FIG. 2 is a schematic cross-section of the combustion chamber of FIG. 1 in a plane at right angles to the plane of the drawing of FIG. 1, indicated by the line II—II drawn in FIG. 1.
Figure 3:
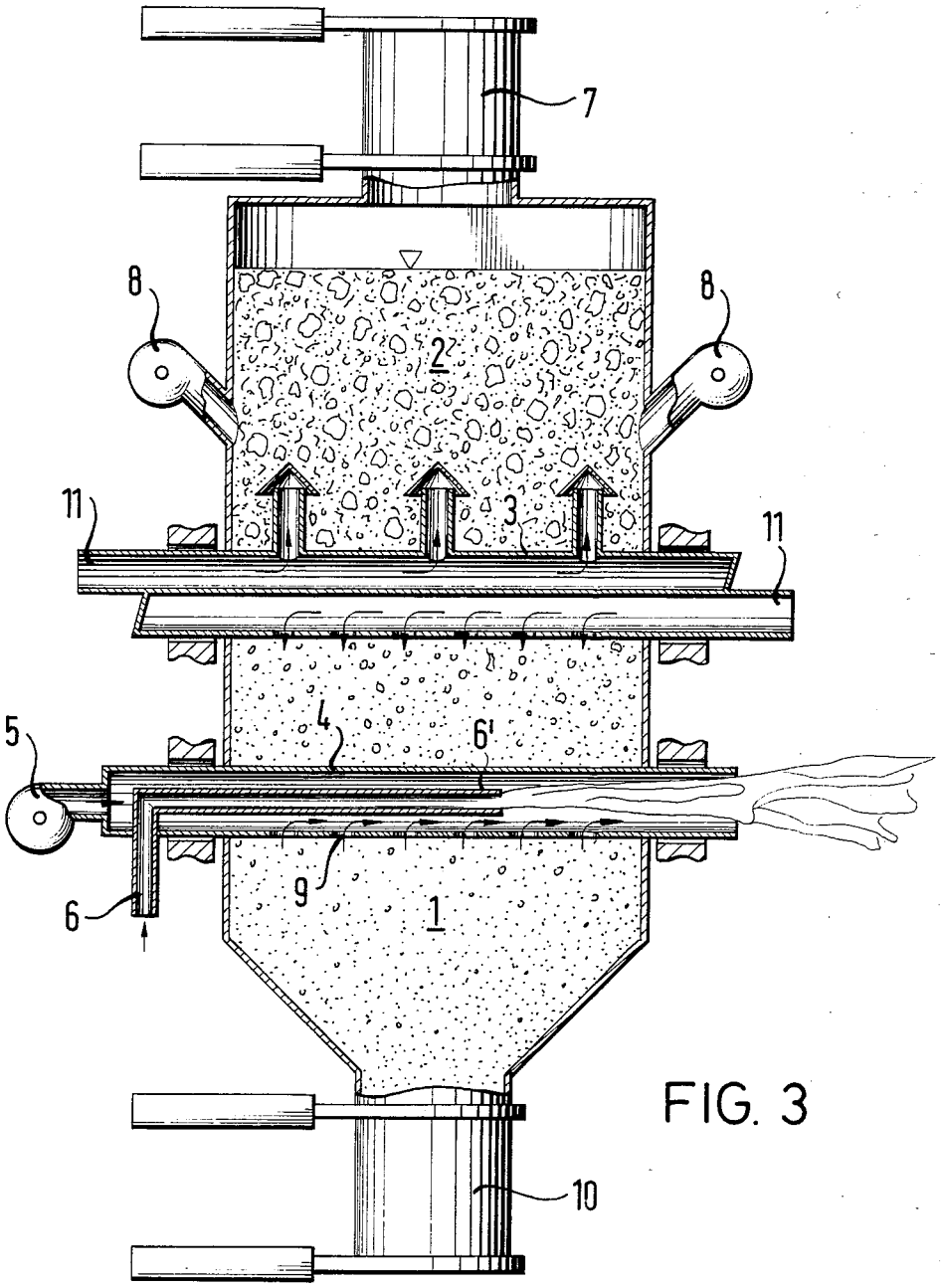
FIG. 3 is a schematic cross-section similar to FIG. 1 of another embodiment of the combustion chamber according to the invention in which the fresh air feed in the gas duct passing through the combustion chamber discharges in the neighborhood of the exit of the gas ducts from the combustion chamber.
Figure 4:
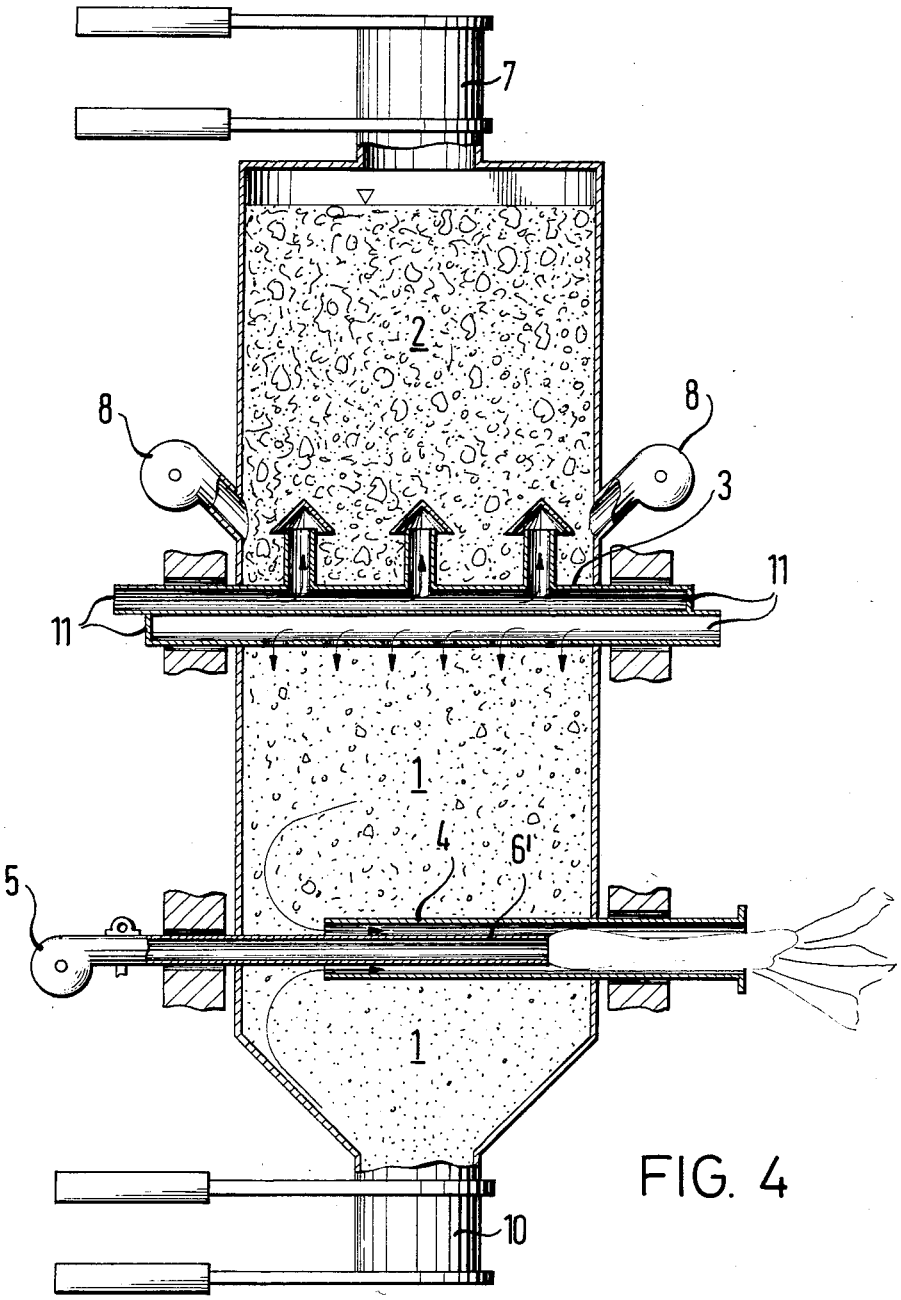
FIG. 4 is a cross-section similar to FIGS. 1 and 3 of a third embodiment of combustion chamber according to the invention in which the duct for separate leading out of the combustible gas starts in the central region of the combustion chamber, and FIG. 5, which appears on the same sheet as FIGS. 1 and 2, is a diagram in the form of a horizontal cross-section looking down on the gas duct of a modified form of combustion chamber according to the invention in which two gas ducts leading out of the combustion chamber are provided.

As shown, for example, in FIG. 1, an incinerator furnace is shown having a combustion chamber 1 which operates downstream of a pyrolysis chamber 2. The two chambers are separated by the sluice structure 3. A similar arrangement is shown in FIGS. 3 and 4.

In the combustion chamber shown in FIGS. 1 and 2, the gas duct 4 passes through the center of the combustion chamber 1. At the upstream end of the gas duct 4 a gas burner is disposed which serves for igniting combustion in the combustion chamber. The fresh air supply line 6 is connected to the gas duct 4, likewise at the upstream end.

For operation of the incinerator furnace combustible material is filled into the pyrolysis chamber 2 through the upper sluice 7. To start the pyrolysis, gas burners 8 are put into action. The combustible gases given off in the pyrolysis chamber are drawn away downward into the combustion chamber 1. There they pass into the gas duct 4 through openings 9. The openings 9 are on the side of the gas duct 4 which faces the ash removal sluicegate 10, which is to say they are disposed facing downward.

During operation of the incinerator, fresh air is introduced by way of the controllable sluice structure 3 over the fresh air duct 11 and this air 1s supplied in substoichiometric quantity both upwards into the pyrolysis chamber 2 and also downwards into the combustion chamber 1. In consequence a firebed glowing at a temperature of about 800° C. is formed above the sluice structure 3 and in this firebed the evolved gases are to a great extent chemically cracked into short-chain hydrocarbon molecules. The heat generated by partial combustion of the materials in the firebed produces pyrolysis of the materials lying above the glowing firebed on the controllable sluice structure 3 where there is a enough air provided for partial combustion. Ash is removed through the gate 10 when or after ash is allowed to fall by opening the sluice structure 3.

The fresh air introduced through the sluice structure 3 into the combustion chamber 1 produces partial combustion of the combustible evolved gases at a temperature in the portion of the combustion chamber lying outside the gas duct 4 which is likewise not more than 800° C. Fresh air in least stoichiometric quantitative ratio to the combustible gases is fed into the gas duct 4 over the fresh air line 6. This has the result of producing a complete combustion of the combustible gases that have entered into the gas duct 4, with a temperature of about 1100° C. being reached. In the embodiment of the combustion chamber according to the invention shown in FIG. 3, the fresh air supply line 6 projects, by a supplementary piece of piping **6*a*, into the gas duct 4** to a place beyond the center of the combustion chamber. The feeding-in place for the fresh air thus lies in the neighborhood of the exit from the combustion chamber, as the result of which the region of combustion of the combustible gases also takes place in the neighborhood of the outlet of the combustion chamber and the hot flame thus formed projects right out of the combustion chamber region.

In the embodiment of combustion chamber according to the invention shown in FIG. 4 the inlet end of the gas duct 4 is in the central region of the combustion chamber 1. The gas duct 4 is in the form of a tube having its end located in the combustion chamber open to the interior of the chamber. The feeding in of fresh air takes place by suction through the pipe section **6*a* projecting into the larger pipe 4, the pipe section 6*a* being opened to the exterior, by means not shown, as soon as the gas burner 5** is shut down, likewise by means not shown.

The use of a single duct 4 passing all or part-way through the combustion chamber 2, as described above, is particularly useful in furnaces in which the combustion chamber, or indeed the entire structure, is basically cylindrical. Particularly in the case of furnaces of rectangular horizontal cross-section it may be convenient to provide a combustion chamber according to the invention with two or more gas ducts for leading combustible gases out of the combustion chamber in a path where they can be consumed at a temperature higher than that which is found in the remainder of the combustion chamber. This is illustrated in FIG. 5 for a case in which there are two such gas ducts 14 and 24, each of the kind shown in FIG. 4. The plural gas ducts are preferably of the same construction, but they may be of any of the kinds illustrated in the other figures, for example. Furthermore, although horizontal disposition of the gas ducts, in which the high temperature complete combustion takes place, is particularly convenient in an incinerator furnace in which there is a pyrolysis chamber above the combustion chamber constituted according to the invention, it is evident that there may be applications of the combustion chamber according to the invention in which the gas duct leading out of the combustion chamber is disposed obliquely or vertically.

It will therefore be seen that although the invention has been described with reference to particular illustrative embodiments, variations and modifications are possible within the inventive concept.

I claim:

1. Method of burning up material which is at least in large part combustible comprising the steps of pyrolyzing said combustible material and burning it with admission of air in quantities insufficient for complete combustion to produce combustible gases at least part of which are not ignited by the burning material, and then leading said combustible gases to a combustion chamber in which they are mixed with air and then burned at a temperature higher than the temperature of the pyrolyzing step, the step of burning said combustible gases at said higher temperature in said combustion chamber being performed by providing a first admission of air into said combustion chamber (1) for partial combustion of said gases in said combustion chamber at a temperature not exceeding 800° C. and by leading said gases from said combustion chamber (1) into a gas duct (4) which is open to the interior of said combustion chamber (1) to an extent adequate for passage of said gases into said duct, and then leading said gases in said duct, separately from the remainder still in said combustion chamber, away from said combustion chamber through a portion thereof while feeding fresh air into said duct for mixing with said gases and for supporting their combustion in said duct at a temperature therein rising above 800° C. as said gases proceed in said duct on their way out of said combustion chamber.

2. Method according to claim 1, in which the path of said gases in said duct begins from a portion of said combustion chamber which does not include a peripheral portion adjacent to the lateral walls of said combustion chamber and which, for at least a quantitative portion of said gases led out of said combustion chamber by said duct, passes through a central portion of said chamber.

3. Method according to claim 1, in which air in substoichiometric quantity ratio is supplied to said combustible gases in said combustion chamber and, supplementarily, air is supplied in at least stoichiometric ratio to the separately ledaway gases in said duct for support of substantially complete combustion of said gases.

4. Method according to claim 2, in which air in substoichiometric quantity ratio is supplied to said combustible gases in said combustion chamber and, supplementarily, air is supplied in at least stoichiometric ratio to the separately ledaway gases in said duct for support of substantially complete combustion of said gases.

5. A furnace for burning up material which is at least in large part combustible, said furnace comprising:

a pyrolysis chamber (2) equipped with first air supply means (8), for producing combustible gases from at least partially combustible non-gaseous material by incomplete combustion;

a controllable sluice (3) which does not block the passage of said combustible gases and forms the bottom of said pyrolysis chamber (2);

a combustion chamber disposed below said sluice for combustion of said combustible gases;

second air supply means (11) for introducing air into the interior of said combustion chamber for support of partial combustion therein at a temperature not exceeding 800° C.;

a duct (4) leading out of said combustion chamber from the interior of said combustion chamber and communicating with the interior of said combustion chamber, forming the outlet of said combustion chamber for said gases, and third air supply means (6) for supplying a sufficient flow of fresh air into the interior of said duct for supporting combustion of said gases therein and thereby causing completion of combustion at a temperature rising above 800° C.

6. Combustion chamber according to claim 5, in which said duct passes completely through said chamber and said lateral walls thereof and at the end of said duct opposite its outlet end at least part of said means (6) provided for supplying fresh air to the interior of said duct are located.

7. Combustion chamber according to claim 5, in which said duct communicates with the interior of said chamber in a region that does not include a peripheral portion of said chamber.

8. Combustion chamber according to claim 6, in which said duct communicates with the interior of said chamber in a region that does not include a peripheral portion of said chamber.

9. Combustion chamber according to claim 7, in which said duct(4) is constituted in tubular form having openings(9) in its tubular walls for entry of said gases into said duct.

10. Combustion chamber according to claim 8, in which said duct(4) is constituted in tubular form having openings (9) in its tubular walls for entry of said gases into said duct.

11. Combustion chamber according to claim 6, in which said means(6) for supplying fresh air into said duct(4) extend, within said duct, from said end of said duct opposite its inlet end towards the portion of said duct nearest the center of said combustion chamber.

12. Combustion chamber according to claim 8, in which said means(6) for supplying fresh air into said duct(4) extend, within said duct, from said end of said duct opposite its inlet end towards the portion of said duct nearest the center of said combustion chamber.

13. Combustion chamber according to claim 5 in which there are a plurality of said ducts (14, 24), said ducts being similarly constituted.

14. Combustion chamber according to claim 6, in which there are a plurality of said ducts (14, 24), said ducts being similarly constituted.

15. Combustion chamber according to claim 5 in which the top of said chamber is constituted at least in part by a controllable sluice(3) through which or around which said gases can pass into said combustion chamber, above which is a pyrolysis chamber(2) and on which a fire bed of said combustible material can be caused to burn for generation of said gases and reducing of said combustible material to ashes, ash-removal means(10) being located at the bottom of said combustion chamber for removal of ash when or after ash is allowed to fall by opening of said sluice.

16. Combustion chamber according to claim 6 in which the top of said chamber is constituted at least in part by a controllable sluice(3) through which or around which said gases can pass into said combustion chamber, above which is a pyrolysis chamber(2) and on which a fire bed of said combustible material can be caused to burn for generation of said gases and reducing of said combustible material to ashes, ash-removal means(10) being located at the bottom of said combustion chamber for removal of ash when or after ash is allowed to fall by opening of said sluice.

17. Combustion chamber according to claim 7 in which the top of said chamber is constituted at least in part by a controllable sluice(3) through which or around which said gases can pass into said combustion chamber, above which is a pyrolysis chamber(2) and on which a fire bed of said combustible material can be caused to burn for generation of said gases and reducing of said combustible material to ashes, ash-removal means(10) being located at the bottom of said combustion chamber for removal of ash when or after ash is allowed to fall by opening of said sluice.

18. Combustion chamber according to claim 10 in which the top of said chamber is constituted at least in part by a controllable sluice(3) through which or around which said gases can pass into said combustion chamber, above which is a pyrolysis chamber(2) and on which a fire bed of said combustible material can be caused to burn for generation of said gases and reducing of said combustible material to ashes, ash-removal means(10) being located at the bottom of said combustion chamber for removal of ash when or after ash is allowed to fall by opening of said sluice.

19. Combustion chamber according to claim 17, in which said openings(9) in the tubular wall of said duct(4) are located in the lower portions of said duct, which are the portions of said duct on its side near said ash removal means(10).

20. Combustion chamber according to claim 18, in which said openings(9) in the tubular wall of said duct(4) are located in the lower portions of said duct, which are the portions of said duct on its side near said ash removal means(10).

* * * * *